US006133810A

United States Patent [19]

Shockley

[11] Patent Number: 6,133,810

[45] **Date of Patent: *Oct. 17, 2000**

[54] ENHANCED COAXIAL CAVITY FILTER CONFIGURED TO BE TUNABLE WHILE SHORTED

[75] Inventor: Paul R. Shockley, Salisbury, Md.

[73] Assignee: K & L Microwave, Inc., Salisbury, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 09/007,827

[22] Filed: Jan. 15, 1998

[51] Int. Cl.[7] ..... H01P 1/202; H01P 1/208

[52] U.S. Cl. ..... 333/207; 333/224; 333/225; 333/232; 333/235; 333/209

[58] Field of Search ..... 333/207, 209, 333/223–226, 231–233, 235; 334/10, 7

[56] References Cited

U.S. PATENT DOCUMENTS

| | | | |
|---|---|---|---|
| 2,272,062 | 2/1942 | George | 333/207 X |
| 2,858,440 | 10/1958 | Giacoletto | 333/235 X |
| 2,995,713 | 8/1961 | Thompson | 333/235 X |
| 3,143,716 | 8/1964 | Leet et al. | 333/209 |
| 3,521,199 | 7/1970 | Wehner | 333/207 |
| 3,555,465 | 1/1971 | Kuroda et al. | 333/207 X |
| 3,811,101 | 5/1974 | Karp | 333/231 X |
| 4,456,895 | 6/1984 | Landt et al. | 333/202 X |
| 5,051,713 | 9/1991 | Yokota | 333/212 |

*Primary Examiner*—Robert Pascal
*Assistant Examiner*—Barbara Summons
*Attorney, Agent, or Firm*—Banner & Witcoff, Ltd.

[57] ABSTRACT

An enhanced tunable coaxial cavity filter that may be tuned while it is shorted. The coaxial cavity filter may have one or more cavities. One or more of the cavities may include a switch for shorting the cavity. When a plurality of cavities are implemented, the cavities may be coupled in series such that shorting one of the cavities effectively shorts the entire filter. The switch for shorting the cavity may include a solenoid switch. The solenoid switch may be disposed within a stator that is stationary with respect to a rotatable rod for tuning the filter. Such a design has shown to be extremely robust for wear, vibration, and other considerations, even in high stress environments.

41 Claims, 4 Drawing Sheets

ENHANCED COAXIAL CAVITY FILTER CONFIGURED TO BE TUNABLE WHILE SHORTED

BACKGROUND OF THE INVENTION

This invention relates to filters and, in particular, to systems and methods for use in implementing an improved multi-coupler in wireless communication systems and, in particular, improvements in capacitive air gap cavity filters utilized to implement a multicoupler.

Referring to FIG. 1, conventional systems include an air variable capacitor filter 100 which includes an LC inductively coupled circuit 101 for each of the air variable capacitor gap cavities. In a typical arrangement there may be any number of air variable capacitor cavities capacitively (not shown) and/or inductively 102 coupled together in series and/or in parallel arrangement. In one conventional multicoupler 103, there may be as many as four air gap filter units 100A, 100B, 100C, 100D coupled together in a rack mount unit 110. The multicoupler 103 couples each of the air gap filter units to provide filter characteristics having bandpass filters at spaced frequencies. For example, where four air variable capacitor cavities are utilized, the multicoupler 103 may couple four air variable capacitor cavities to form four spaced bandpass regions. As shown in FIG. 3, the regions may be between 225 megahertz and 400 megahertz such as, for example, at 232, 250, 275, and 300 megahertz center frequencies.

A conventional multicoupler may include a mechanical connection at the antenna input port to short the antenna input when a capacitive air gap cavity filter is unplugged from the multicoupler to allow other capacitive air gap cavity filters to continue to operate.

FIG. 3 shows the four air gap capacitive filters having a bandpass B1, B2, B3 and B4. With an air variable capacitor filter, each filter may be tuned to a different center frequency by adjusting, for example, the capacitance. The dotted line in FIG. 3 shows the filter B1 being tuned through the center frequency range of the B2 filter. However, a problem will occur where the B1 filter passes through the B2 filter resulting in an impedance mismatch. In the event of an impedance mismatch, when the B1 filter is tuned through the center frequency range of the B2 filter, a high insertion loss and a high reflection occurs. This results in a loss of the signal for an instant in time until the B1 filter is tuned beyond the B2 filter. Accordingly, a problem exists with the prior art which has not been heretofore solved by using conventional tuning techniques.

Where a plurality of filters are coupled to a single antenna with a single signal splitter in the rack mount which splits the antenna signal into four separate bandpass filters with separate outputs and a single input from the antenna, the high reflective and/or high insertion loss as the two filters are tuned past each other may cause the user application software to totally shut down as a result of the error condition by having a signal going into the filter and no signal coming out of the filter. This may cause severe problems in some systems including loss of data and/or loss of operational capability for the system.

Accordingly, a solution is required to overcome the above mentioned problems.

SUMMARY OF THE INVENTION

Aspects of the present invention include achieving a multicoupler design which overcomes the above mentioned problems to create an improved multicoupler.

In one aspect of the present invention, a switch is included which may be selectively controlled to be actuated as one bandpass filter is tuned through another bandpass filter in a tunable coaxial cavity filter. The switch may be operative to short-out the one or more coaxial cavities forming the multicoupler and thus avoid the above mentioned problems. The switch may be optionally included as a solenoid actuated switch disposed in the resonator of an air variable capacitor filter. The use of the solenoid actuated switch is desirable since it may operate very quickly without the need to turn a tuning arm of the filter to a predetermined position. Thus, the solenoid actuated switch allows the tuning arm to be repositioned while the switch is activated. Further, the switch is very reliable and relatively inexpensive to manufacture.

In further embodiments of the invention, a fail-safe mechanism may cause the filter to short out in the event of a power failure. This may be done through the use of a biased switch which is held in the non-engaged position by the application of power and which activates in the event that power fails or is removed.

Alternate aspects of the invention include one or more of the devices, elements, and/or steps described herein in any combination or subcombination. It should be clear that the claims may recite or be amended to recite any of these combinations or subcombinations as an invention without limitation to the examples in the specification.

DETAILED DESCRIPTION OF THE PREFERRED EMBODIMENTS

Figure 4:
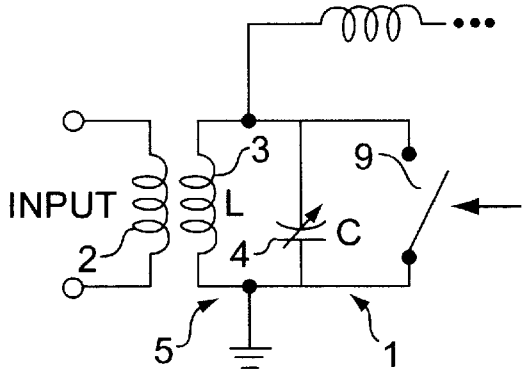
FIG. 4 shows a circuit diagram of one section of an air variable capacitor filter in accordance with the present invention.

A circuit diagram showing the electrical arrangement of a circuit representative of one aspect of the invention is shown in FIG. 4. As shown in FIG. 4, one or more air variable capacitor filters 1 may include a switch 9 which shorts the LC inductive circuit 5 composed of variable capacitor 4 and inductor 3 to ground. The input to the circuit is provided by a low inductive coupling through inductor 2 to the inductor 3 of the LC circuit 5. The switch 9 may be electromagnetically controlled such as through the use of a solenoid in one or more of the capacitive elements C. For example, the switch for shorting the LC capacitive resonating circuit 5 may be disposed inside the resonator and may be formed using a solenoid which shorts the capacitor. When the capacitor is shorted, an associated coaxial cavity is shorted to ground and thus prevents a signal from passing through the air gap coaxial cavity filter. The filter may be utilized on the receive end and/or the transmit end of the air variable capacitor filter. Where the air variable capacitor filter is a bidirectional filter, it may be desirable to include a switch for shorting a coaxial cavity on both the transmit and receive ends of the filter.

Figure 6:
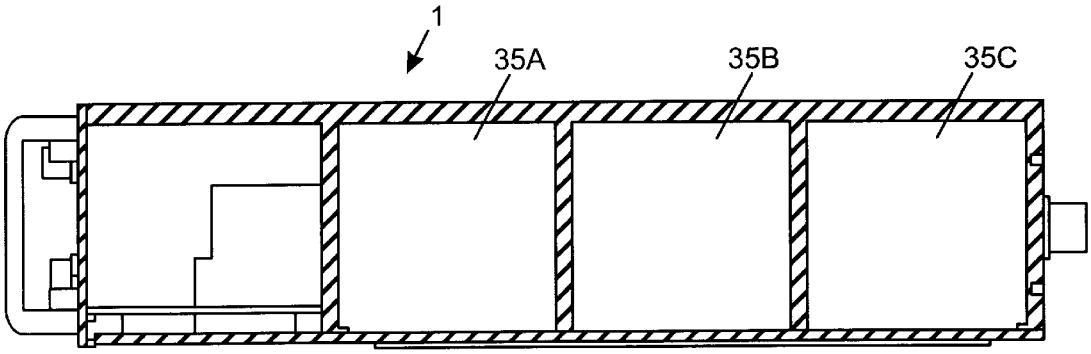
FIG. 6 shows a cross sectional side view of the air variable capacitor filter shown in FIG. 5.
Figure 5:
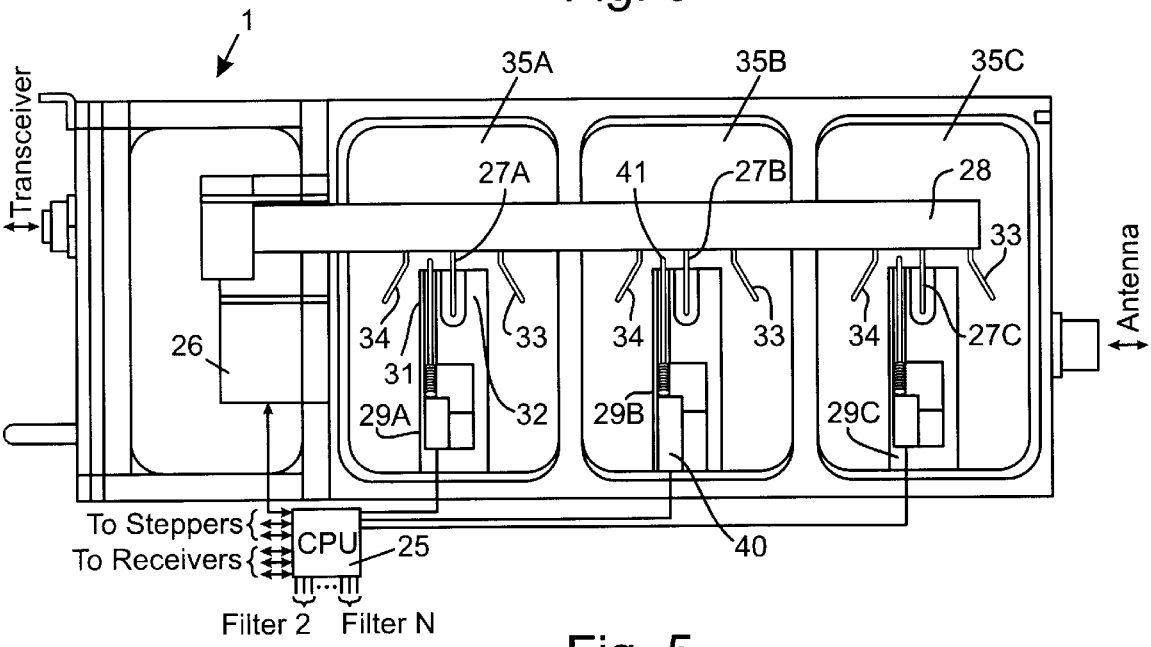
FIG. 5 shows a top view of one embodiment of the air variable capacitor filter shown in the circuit diagram of FIG. 4.

An exemplary embodiment of the improved air gap filter is shown in FIG. 5 where CPU 25 controls stepper motor 26 which in turn controls rotating rod 28, which in turn rotates disks 27A–27C respectively through resonators 29A through 29C. Where a solenoid is included in one or more of the resonators 29A through 29C, the solenoid may be operative to short an associated resonator 29A–29C to the rotating rod 28 and therefore shut down the filter 1 by shorting an associated coaxial cavity 35A–35C. A cross-sectional side view of the air variable capacitor filter 1 is shown in FIG. 6.

Figure 7:
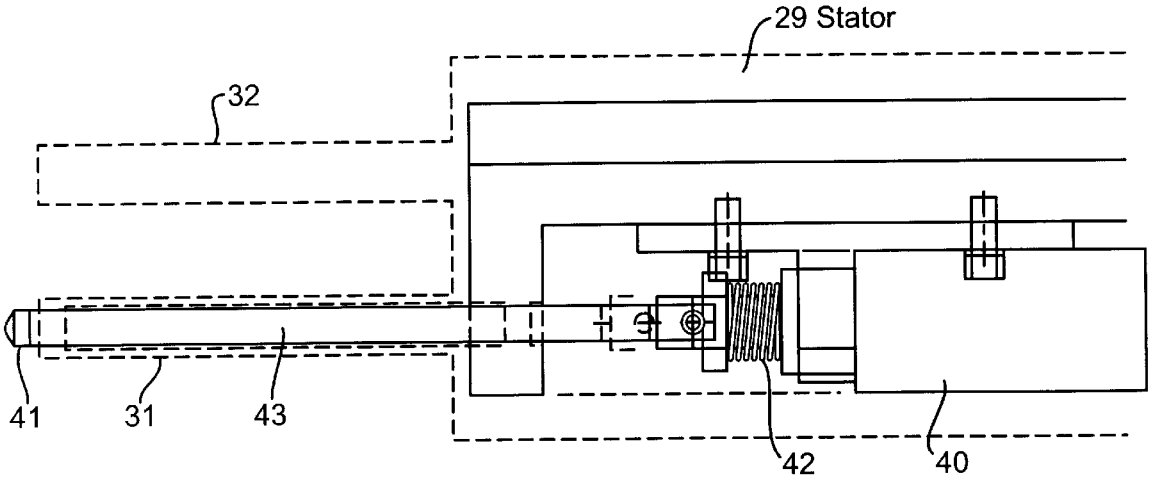
FIG. 7 shows one example of a solenoid based switch disposed inside a resonator of an air variable capacitor filter.
Figure 8:
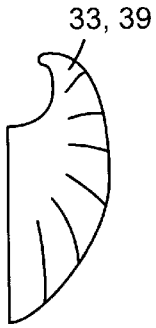
FIGS. 8 and 9 show various examples of tines which may be utilized in the air variable capacitor filter.
Figure 9:
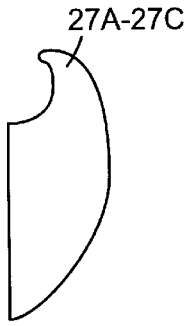

The resonators 29A–C and/or the capacitive plates 27A–C may be variously configured. For example, the resonators may or may not include a switch 9. Where the resonators include a switch 9, the switch may be configured as a solenoid switch. Referring to FIG. 7, a resonator may include a stator 29 having a plurality of tines or stator forks 31, 32. The tines or stator forks 31, 32 may be utilized in conjunction with one or more capacitive plates 33, 34 to form the resonator. The additional capacitive plates 33, 34 may be in addition to the capacitive plates 27A–27C. It may be particularly useful to use the additional capacitive plates 33, 34 where the stator forks 31, 32 are configured as non-rounded but rectangular stator forks. The additional capacitive plates 33, 34 may be serrated such that the capacitive plates can be bent in and out to provide fine tuning adjustment for the filter over a plurality of different frequencies. The capacitive plates 27A–27C may be a solid plate which may, in exemplary embodiments, be filed to adjust capacitance of the coaxial cavity. However, in other embodiments, it may be desirable to utilize the additional capacitive plates 33, 34 to adjust the capacitance of the resonator 5.

In the event that a plurality of tines from the stator are utilized, the solenoid may be located in either one and/or both tines. FIG. 5 shows an exemplary embodiment of the resonator in which a shorting end 41 of the solenoid 40 shorts the stator 29 to the rod 28. The solenoid may be biased using spring 42 such that the shorting end 41 of the solenoid 40 shorts the capacitor (e.g., by connecting the stator to the rotating rod 28) in the event of a power shortage. This provides a particular fail safe mechanism whereby the filters short out in the event of a power failure or other system wide failure.

The switch 9 may also be utilized where the filter is defective and/or any one of the stepper motor sensors or other components are determined to be inoperative. In this manner, the filters may be brought on line and off line via software control by simply shorting the resonator to the ground point such as the rotating rod 28. Thus, a spare filter may be switched in and out using the same mechanism such as switch 9 which is utilized for tuning the filters without transmit/receive instability. The solenoid shown in FIG. 7 may be configured to be any suitable solenoid such as a Lucas solenoid part number 195202234. The solenoid may include any suitable interconnection mechanism such as a push rod 43. The push rod 43 is preferably grounded via a canted spring 42. The canted spring 42 may be any suitable spring such as one manufactured by BAL SEAL and composed of a beryllium copper alloy. It is desirable to locate the ground of the solenoid push rod 43 as close as possible to the end of the push rod to prevent any capacitive and/or inductive coupling with the resonator 29A–29C. For example, the solenoid may be located in the end cavity as close to the antenna port as possible. Further, the solenoid may be redundant such that a separate solenoid is provided in each tine of the stator. The redundant solenoid may be desirable in high reliability systems so that a redundant shut off may be utilized in the event that one of the solenoids is inoperative. The switch 9 may alternatively be located on either or both tines and in any number of cavities and/or in all three cavities to provide redundancy so that the transceiver operates into a low reflected power.

A multi-port combiner may have any number of inputs from the antenna to be combined in a susceptance annulling network. For example, a four port combiner has four inputs from the antenna to be combined using a susceptance annulling network. As is well known in the art, the susceptance annulling network may include a three transformation passive combiner which is an all pass network for passing all signals within the frequency band, e.g., using a low insertion loss broadband bandpass filter similar to a standard splitter. The splitter works similar to a TV splitter, except the 3 dB insertion loss associated with the TV splitter is much lower using the susceptance annulling network (0.5 dB) as may be made by those skilled in the art, particularly in light of the foregoing teachings. For example, each of the elements of the aforementioned embodiments may be utilized alone or in combination with elements of the other embodiments.

In the multi-port combiner or multicoupler, the transceiver typically shuts down in order to tune the filter to a new location. By shutting down the filter, the filter may be tuned to another frequency without disrupting the other communication channels. In the most preferred embodiment, the solenoid is in the end towards the antenna so as to provide the best performance. If the solenoid is upstream of the cavity towards the antenna, there may still be some reflective power and/or high insertion loss.

With the solenoid switch on, the bandpass signal drops 70 db to where virtually no signal is getting through. Additional testing was performed to ensure that vibration of the system would not interfere with the connection between the solenoid tip 41 and the axial connection 28. The design has shown to be extremely robust even in high stress environments. For example, the solenoid tip 41 shows only marginal wear when vibrated at a 2 g level for thirty minutes. Thus, the design is highly robust for wear, vibration and other considerations.

As a further design consideration, it should be noted that the solenoid should be capable of fully retracting into the resonator and consistently retracting at the same length each time so as not to effect the tuning of the device. Doubling the gap in the resonator also allows for increased power handling capability.

In operation, as the two signals pass over each other, the insertion loss may be as much as an additional three and one-half db resulting in more than a fifty percent reduction in power. So approximately one quarter of the power. So with one hundred watts input power and twenty-five watts output power the insertion loss would be 6 dB.

Figure 1:
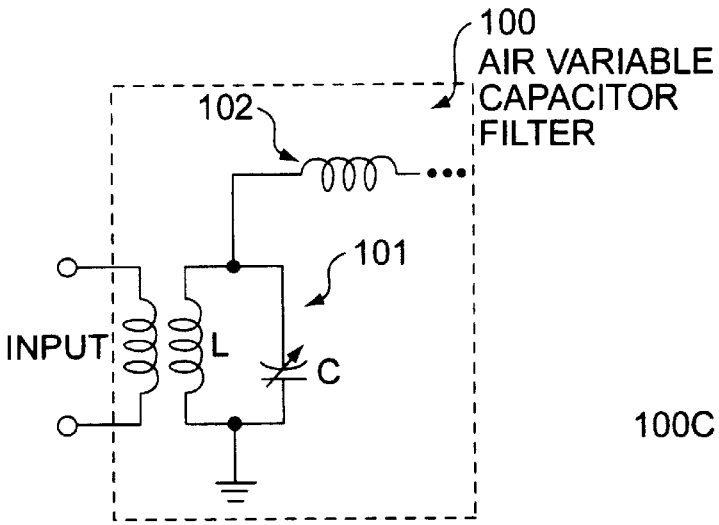
FIG. 1 PRIOR ART
FIG. 1 is a circuit diagram of one section of a conventional air variable capacitor filter.
Figure 2:
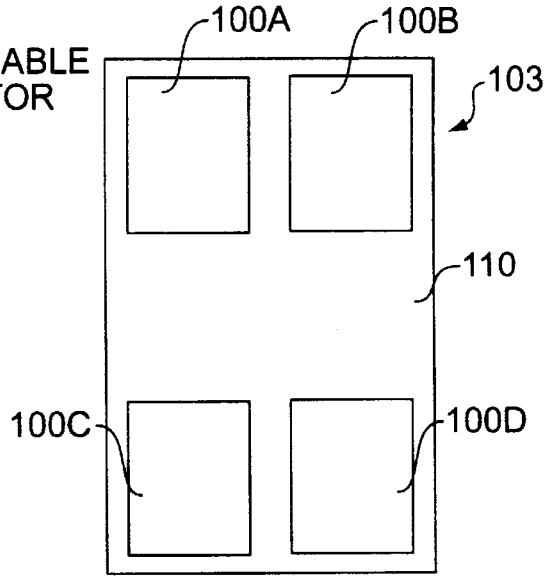
FIG. 2 shows four air variable capacitor filters disposed in a rack mount unit.
Figure 3:
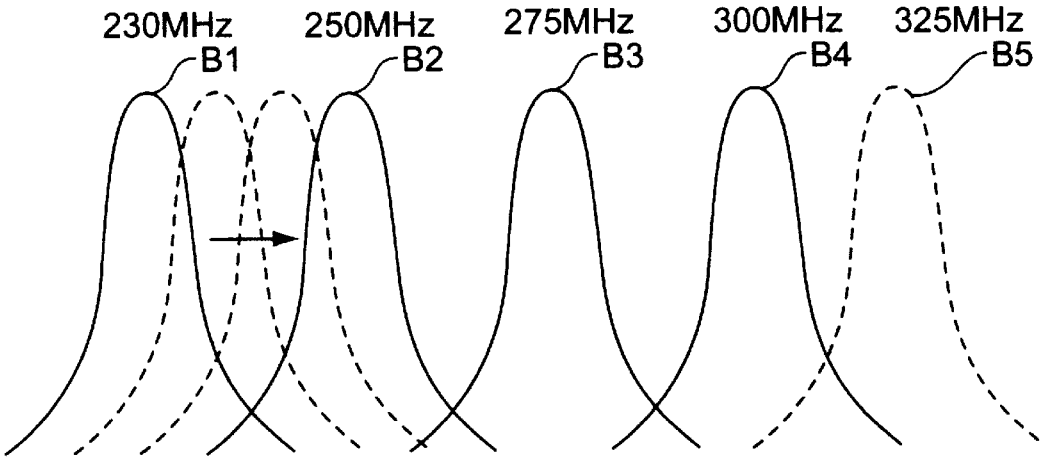
FIG. 3 shows the tuning of one of the air variable capacitor filters in a multicoupler through a tuning range.
Figure 10:
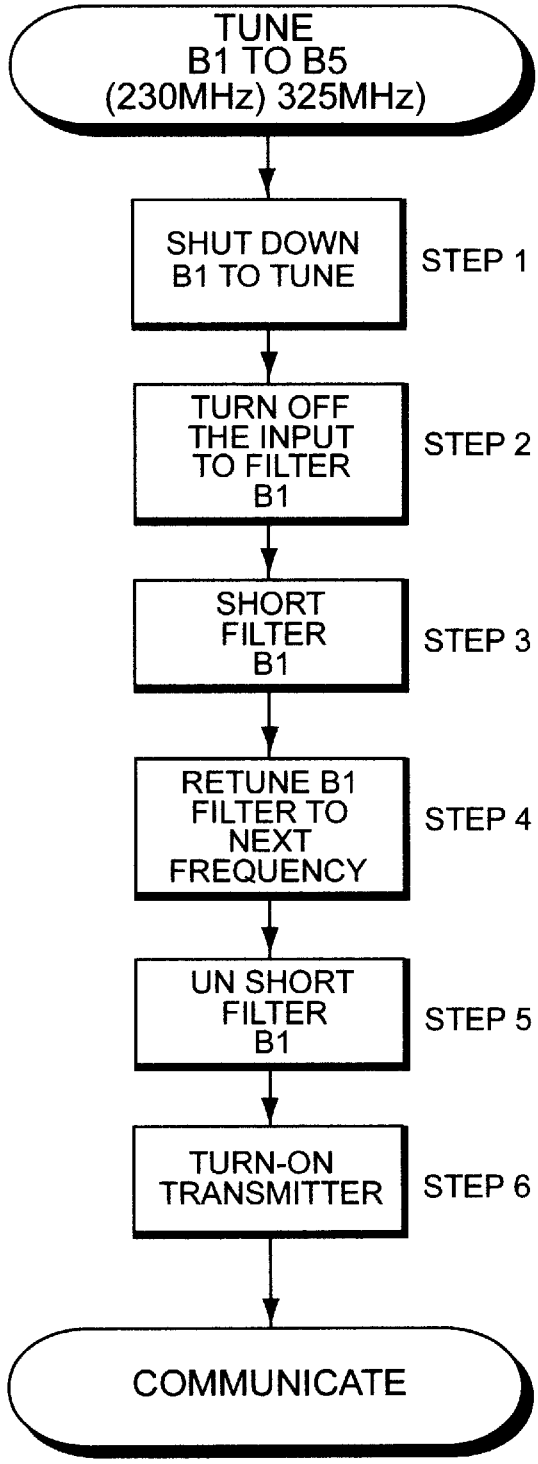
FIG. 10 shows a flow diagram of steps which may be utilized in controlling an air variable capacitor filter in accordance with the invention.

An exemplary operation of the transparent tuning device 1 is, for example, to tune the device from B1 up to a new position B5 as shown in FIG. 3 along the dotted line. Following the flow chart shown in FIG. 10, the first step (step 1) is to shut down the filter associated with bandpass characteristic B1 using, for example, switch 9 to short the resonator to ground. The switch 9 may for example be a solenoid at the open circuit end of the resonator which shorts against a rotating rod which rotates a metal plate through the resonator and hence varies the capacitance. As shown in FIG. 10, step 2 may include turning off the input to the filter by shutting down any transmission through the filter. Step three is to short the filter using the solenoid from the resonator to the ground which is the rod extending through the three capacitive cavities and used to rotate the capacitor through the resonator. Step four is to retune the filter to the new frequency as, for example, moving between B1 and B5. Step five is to unshort the filter, i.e., by disconnecting solenoid 9 and allowing the resonant LC circuit 5 to operate. Step six is to turn on the input to the filter and step seven is to communicate.

While exemplary systems and methods embodying the present invention are shown by way of example, it will be understood, of course, that the invention is not limited to these embodiments. Modifications may be made by those skilled in the art, particularly in light of the foregoing teachings. For example, each of the elements of the aforementioned embodiments may be utilized alone or in combination with elements of the other embodiments. Additionally, other methods for shorting the air gap capacity filter may be a pin diode switch and/or other type of switching arrangement. However, this may be problematic where high power air gap capacity filters are utilized. For example, at 100 watt levels, the diode may be forward biased and thus not be operational. An added advantage of the present invention is being able to short out the filter at the same time it is being tuned using a mechanical device. Although the filter may be able to be shorted out by designing the tuning capacitor to short against the cavity wall while it is tuned all the way to an extreme direction, this solution is not acceptable where it is desirable to short the air variable capacity filter while it is being tuned. Additionally, the current capacitor allows for shorting in the event of a motor failure whereas a shorting configuration which relies on the motor would not be as reliable. Furthermore, it will be understood that while some examples of implementations are discussed above regarding the receiving components, the same principals, configurations and methods may be applied to transmitting circuitry. Accordingly, the appended claims are intended to cover all such alternate embodiments of the inventions.

What is claimed is:

1. An apparatus comprising:

a tunable cavity filter including:

a stator; and a switch including a solenoid disposed in the stator, whereby the switch is configured such that activation of the switch causes the tunable cavity filter to be shorted-out.

2. The apparatus of claim 1 wherein the switch is positioned such that the cavity filter is tunable while the switch is shorting the cavity.

3. The apparatus of claim 1 wherein the switch is biased in the closed position such that, upon a power failure, the switch shorts the cavity filter.

4. An apparatus comprising:

a tunable cavity filter including:

a cavity;

a resonator disposed within the cavity; and a solenoid disposed within the resonator and operative to short-out the cavity responsive to the solenoid being engaged, whereby the tunable cavity filter is shorted-out.

5. The apparatus of claim 4, wherein the solenoid is engaged upon power being supplied to the solenoid.

6. An apparatus comprising:

a tunable cavity filter including:

a first cavity;

a second cavity coupled in series with the first cavity; and a first switch configured to short-out the first cavity, wherein the tunable cavity filter acts as a tunable bandpass filter having a passband center frequency, whereby the first switch is configured to substantially prevent a received electromagnetic wave from passing through the tunable cavity filter at the passband center frequency while the first switch is shorting the first cavity.

7. The apparatus of claim 6, wherein the tunable cavity filter is tunable while the first cavity is shorted by the first switch.

8. An apparatus comprising:

a tunable cavity filter including:

a first cavity;

a second cavity coupled in series with the first cavity; and a first switch, whereby the first switch is configured such that activation of the switch causes the tunable cavity filter to be shorted-out.

9. The apparatus of claim 8, further including a rotatable tuning member at least partially disposed within the first cavity for tuning the tunable cavity filter according to a rotation position of the tuning member.

10. The apparatus of claim 9, further including a motor for rotating the tuning member.

11. The apparatus of claim 10, further including a processor for controlling rotation of the motor and for controlling the first switch.

12. The apparatus of claim 11, wherein the first switch comprises a first solenoid, the processor being configured to control the first solenoid.

13. The apparatus of claim 9, further including a first stator disposed substantially within the first cavity.

14. The apparatus of claim 13, further including a second stator disposed substantially within the second cavity.

15. The apparatus of claim 14, further including a second switch comprising a second solenoid disposed substantially within the second stator.

16. The apparatus of claim 13, wherein the tuning member has a capacitive plate that is capacitively coupled with the first stator.

17. The apparatus of claim 16, wherein the tuning member is configured to tune the tunable cavity filter responsive to a rotation of the tuning member by changing a capacitance between the capacitive plate and the first stator.

18. The apparatus of claim 16, wherein the first stator has a plurality of stator forks, the capacitive plate being capacitively coupled with the plurality of stator forks.

19. The apparatus of claim 9, further including a resonator disposed substantially within the first cavity, the first switch being configured to short the first cavity when the first switch is engaged by electrically connecting the resonator to the tuning member.

20. The apparatus of claim 8, wherein the first switch comprises a first solenoid.

21. An apparatus comprising:

a tunable cavity filter including:

a cavity;

a tuning member at least partially disposed within the cavity and configured to tune the tunable cavity filter according to a rotation position of the tuning member; and a switch configured to short-out the cavity such that the tunable cavity filter is shorted-out when the cavity is shorted-out.

22. The apparatus of claim 21, wherein the tunable cavity filter acts as a tunable bandpass filter having a passband center frequency, the switch substantially preventing an electromagnetic wave from passing through the tunable cavity filter at the passband center frequency while the switch is shorting the cavity.

23. The apparatus of claim 21, wherein the tunable cavity filter is tunable while the cavity is shorted by the switch.

24. The apparatus of claim 21, further including a stator disposed substantially within the cavity.

25. The apparatus of claim 24, wherein the tuning member has a capacitive plate configured to be capacitively coupled with the stator.

26. The apparatus of claim 25, wherein the tuning member tunes the tunable cavity filter responsive to a rotation of the tuning member by changing a capacitance between the capacitive plate and the stator.

27. The apparatus of claim 25, wherein the stator has a stator fork, the capacitive plate being capacitively coupled with the stator fork.

28. The apparatus of claim 21, further including a resonator disposed substantially within the cavity, the switch being configured to short the cavity by electrically connecting the resonator to the tuning member.

29. An apparatus comprising:

a tunable cavity filter including:

a cavity;

a tuning member at least partially disposed within the cavity for tuning the tunable coaxial cavity filter according to a rotation position of the tuning member;

a switch for shorting out the cavity such that the tunable cavity filter is shorted when the cavity is shorted; and a stator disposed substantially within the cavity, wherein the switch comprises a solenoid disposed substantially within the stator.

30. A method comprising the steps of:

shorting-out a first tunable cavity filter;

tuning the first tunable cavity filter while the first tunable cavity filter is shorted-out; and un-shorting-out the first tunable cavity filter.

31. The method of claim 30, wherein the step of shorting-out includes shorting-out the tunable cavity filter such that an electromagnetic wave is substantially prevented at a first frequency from passing through the tunable cavity filter, the tunable cavity filter acting as a tunable bandpass filter having a passband center frequency equal to the first frequency.

32. The method of claim 30, wherein the step of shorting includes engaging a solenoid switch of the first tunable cavity filter.

33. The method of claim 30, wherein the step of tuning includes rotating a tuning member of the first tunable cavity filter.

34. A method comprising the steps of:

shorting-out a first tunable cavity filter;

tuning the first tunable cavity filter while the first tunable cavity filter is shorted-out; and un-shorting-out the first tunable cavity filter, wherein the step of shorting includes shorting the tunable cavity filter such that an electromagnetic wave is substantially prevented at a first frequency from passing through the tunable cavity filter, the tunable cavity filter acting as a tunable bandpass filter having a passband center frequency equal to the first frequency, and wherein the step of tuning includes tuning the first tunable cavity filter such that the passband center frequency changes from the first frequency to a second frequency in an analog fashion, a second cavity filter being coupled to the first tunable cavity filter and acting as a bandpass filter having a passband center frequency between the first passband center frequency and the second passband center frequency.

35. An apparatus comprising:

a tunable cavity filter including:

a first cavity;

a resonator disposed at least partially within the first cavity, the resonator having a plurality of tines; and a solenoid disposed at least partially within the resonator, the solenoid having an elongated conductive member slidably disposed in one of the plurality of tines whereby the elongated conductive member is operative to short-out the tunable cavity filter including the first cavity.

36. The apparatus of claim 35, wherein the conductive member is slidable beyond an end of the one of the plurality of tines, the conductive member causing the first cavity to be shorted responsive to the conductive member sliding sufficiently far beyond the end of the one of the plurality of tines.

37. An apparatus comprising:

tunable cavity filter including:

a first cavity;

a resonator disposed at least partially within the first cavity, the resonator having a plurality of tines;

a solenoid disposed at least partially within the resonator, the solenoid having an elongated conductive member slidably disposed in one of the plurality of tines and operative to short the first cavity; and a tuning member extending at least partially into the first cavity, the first cavity being shorted responsive to the conductive member sliding so as to physically contact the tuning member.

38. The apparatus of claim 37, wherein the tuning member includes a capacitive plate located so as to move within a space between two of the plurality of tines, the plate capacitively coupling the tuning member with the two of the plurality of tines.

39. An apparatus comprising:

a tunable cavity filter including:

a first cavity;

a resonator disposed at least partially within the first cavity and having a plurality of tines;

a solenoid disposed at least partially within the resonator, the solenoid having an elongated conductive member slidably disposed in one of the plurality of tines and operative to short the first cavity; and a tuning member, wherein the tuning member comprises a rod.

40. An apparatus comprising:

a tunable cavity filter including:

a first cavity;

a second cavity coupled in series with the first cavity;

a first switch for shorting the first cavity;

a rotatable tuning member at least partially disposed within the first cavity for tuning the tunable cavity filter according to a rotation position of the tuning member; and a first stator disposed substantially within the first cavity, wherein the first switch comprises a first solenoid disposed substantially within the first stator.

41. An apparatus comprising:

A tunable cavity filter including:

a cavity;

a resonator disposed within the cavity; and a solenoid disposed within the resonator and operative to short the cavity responsive to the solenoid being engaged; and a tuning member extending at least partially into the cavity, wherein the solenoid includes a conductive member slidably coupled to the resonator, the conductive member sliding toward the tuning member so as to short the cavity responsive to the solenoid being engaged.

* * * * *